United States Patent [19]

Flider

[11] 4,394,937

[45] Jul. 26, 1983

[54] SAFETY CAN CONVERSION APPARATUS

[75] Inventor: Frank S. Flider, Mattoon, Ill.

[73] Assignee: Justrite Manufacturing Company, Chicago, Ill.

[21] Appl. No.: 203,588

[22] Filed: Nov. 3, 1980

[51] Int. Cl.[3] ..... B65D 47/08

[52] U.S. Cl. ..... 222/189; 222/505; 222/517

[58] Field of Search ..... 222/189, 472, 505, 517, 222/556; 220/344

[56] References Cited

U.S. PATENT DOCUMENTS

| | | | |
|---|---|---|---|
| 2,365,695 | 12/1944 | Grice | 222/556 X |
| 3,469,747 | 9/1969 | Richmond | 222/189 X |
| 3,811,605 | 5/1974 | Flider | 222/505 X |
| 3,844,456 | 10/1974 | Schiemann | 222/472 X |
| 4,273,265 | 6/1981 | Anderson | 222/189 |

*Primary Examiner*—F. J. Bartuska
*Attorney, Agent, or Firm*—Irwin C. Alter

[57] ABSTRACT

A safety dispensing conversion device for converting storage containers of inflammable fluids such as gasoline or the like, such as the well-known "jerry can", into a container with safety dispensing features. A pour spout, a flame arrester extending from the pour spout interiorly of the container, a safety cap in a normally closed relation to the pour spout, and a spring-biased control handle and linkage arrangement mounted on the upper end of the container and connected to the safety cap to cause opening of the safety cap upon movement of the control handle in an opening direction, and insuring closing of the safety cap due to the action of the biasing spring when the control handle is released, in modular form, is integrated into such a container. The resulting container has the characteristics of a jerry can which permit stacking of the converted containers for efficiency in storage and transportation, with the converted container also having the safety dispensing features not found in prior art jerry cans.

20 Claims, 13 Drawing Figures

FIG.9
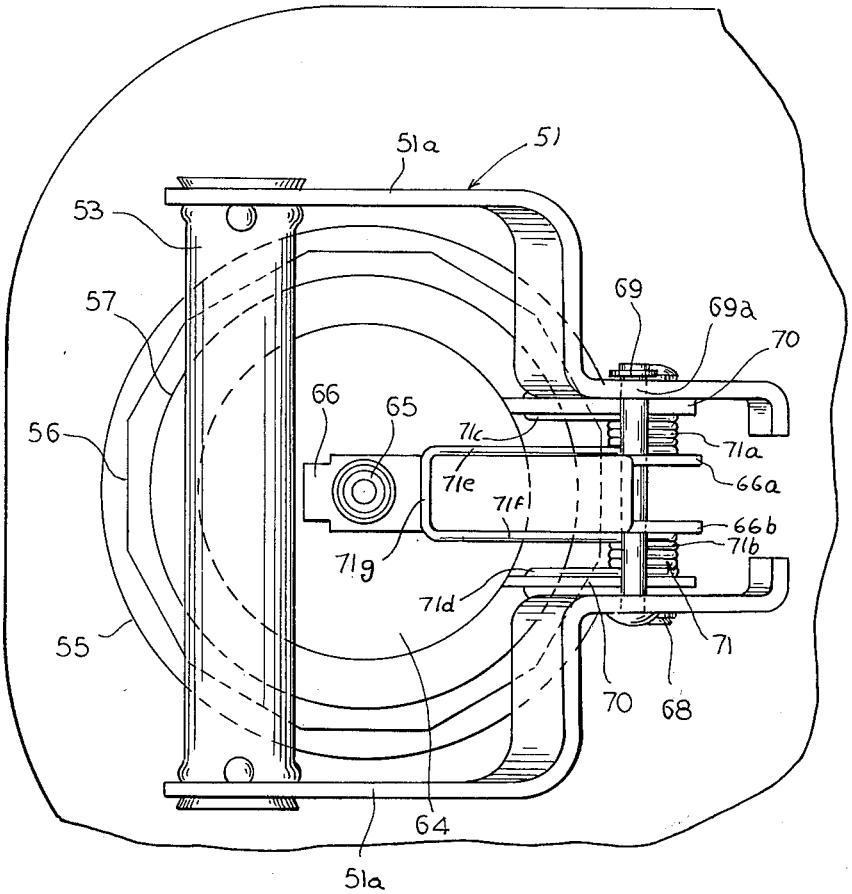
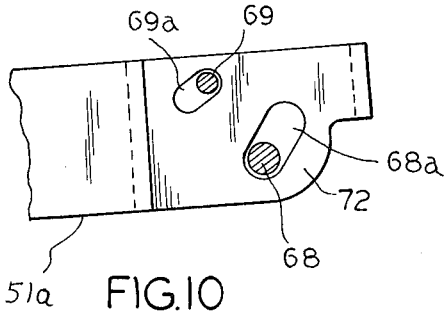
FIG.10
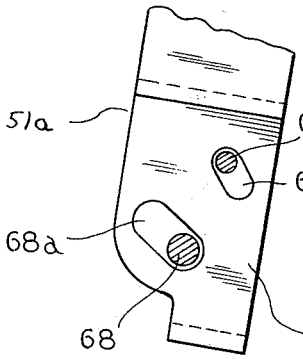
FIG.12
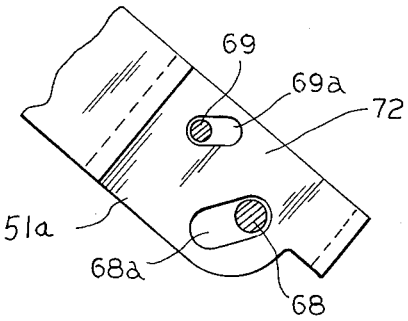
FIG.11
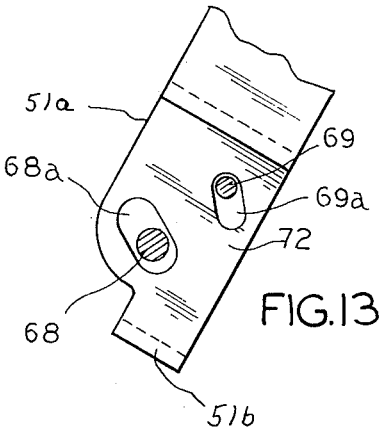
FIG.13

SAFETY CAN CONVERSION APPARATUS

BACKGROUND OF THE INVENTION

This invention relates to cans or containers for holding fluids and especially, although not exclusively, to containers for inflammable fluids such as gasoline and the like, and more particularly to the so-called "jerry can".

Particularly, the invention relates to a container which has been converted into a "safety can" and to the adapter arrangement for effecting the conversion of the container into a safety can.

It is well known in the prior art to use containers which are popularly known as "jerry cans" to store inflammable fluids such as gasoline. The containers may be made of steel or plastic and are so contoured and constructed that they may easily be stacked in a nested relation, one atop the other, for efficient space utilization during storage and transportation.

The following U.S. patents show examples of prior art jerry Cans.

U.S. Pat. No. 3,746,200—issued to Frank S Flider on July 17, 1973; and

U.S. Pat. No. 3,940,002—issued to Wofram Schiemann on Feb. 24, 1976.

As best seen in the aforementioned Flider patent, the prior art jerry can is provided with a simple cap member which is in screw-threaded engagement with threads inside the neck opening of the can. Similarly, the aforementioned Schiemann patent shows a spout member having external threads which are adapted to engage internal threads of a screw-on type cap member, not shown.

The prior art jerry cans such as those shown in the aforementioned Flider and Schiemann patents are essentially storage receptacles for inflammable fluids, such as gasoline and the like.

On the other hand, it is also well known in the prior art to provide so-called "safety cans" as exemplified by the following U.S. patents:

U.S. Pat. No. 1,312,822—issued to Pahr Anderson on Aug. 12, 1919;

U.S. Pat. No. 3,469,747—issued to Roy H. Richmond, Jr. on Sept. 30, 1969;

U.S. Pat. No. 3,727,807—issued to Frank S. Flider on Apr. 17, 1973;

U.S. Pat. No. 3,729,122—issued to Frank S. Flider on Apr. 24, 1973;

U.S. Pat. No. 3,794,235—issued to Frank. S. Flider on Feb. 26, 1974;

U.S. Pat. No. 3,811,605—issued to Frank S. Flider on May 21, 1974;

U.S. Pat. No. 3,851,791—issued to Frank S. Flider on Dec. 3, 1974.

Safety cans for inflammable fluids, such as those shown by the foregoing patents, are provided with an operating or control handle and linkage arrangement which automatically open a normally closed cap member when the container is tipped, while the handle is held, with the cap reclosing when the container is set down and the handle is released. And while separate flash arrestor adapters exist which have been attachable by friction to fluid containers, none has been usable while simultaneously permitting stacking, together with secure affixation.

Safety cans also usually have a neck portion with a filter screen which strains the inflammable fluid entering and leaving the container and which also serves as a flame arrestor or fire barrier.

However, safty cans of the prior art are generally not contoured or shaped in such a manner that they may be stacked in a nested relation, one atop the other, for efficiency in storage and transportation, for optimum space utilization, and for safely locking the fluid release members into a closed position.

Accordingly, it is an object of the present invention to convert a conventional jerry can into a safety can thereby providing a composite can which has the efficient space utilization features of the jerry can including "nested stacking" and the like and which also has the safety features of the safety can, including a control handle and linkage which automatically opens a normally closed cap upon movement of the operating handle in an opening direction or when the container is tipped while the control handle is held, with the cap automatically reclosing when the container is set down and the control handle is released; one which further includes a flame arrestor extending into the converted can from the pour spout.

It is a further object of the invention to provide an adapter arrangement which permits conversion of a conventional jerry can into a safety can.

It is a further object of the invention to provide an adapter device which is removably mounted on a conventional jerry can.

In achievement of these objectives, there is provided in accordance with the present invention, a safety dispensing container for inflammable fluids such as gasoline and the like, which is constructed by modifying a storage container by the addition of an integrally constructed pour spout, a safety cap in normally closed relation to the pour spout, and a spring-biased operating or control handle and linkage arrangement connected to the safety cap to cause opening of the safety cap upon movement of the control handle in an opening direction, and insuring closing of the safety cap due to the action of the spring-biased control handle when released. More specifically, there is provided in a given container a body having a hollow interior for receiving an inflammable fluid, the upper surface of said body being provided with an opening through which inflammable fluid may be poured, a pour spout secured in said opening, a safety cap adapted to seat on the outer end of said pour spout in closing relation to said pour spout, an operating handle, means mounted to support said handle for pivotal movement, link means connecting said safety cap to said handle whereby pivotal movement of said handle affects opening of said cap, spring means mounted on the upper end of said body and engaging said link means to constantly bias said link means and said cap and handle toward a closed position, and means defining a recessed bottom portion and a normally flat horizontal region on the upper end of said body to serve as a seat for the recessed bottom portion of another container in a nested relation.

A further feature of the invention is the sub-assembly of the fixtures which are mounted on the prior art jerry can to adapt it to receive the safety cap or cover, cover bracket and operating or control handle, and flame arrestor, all of which cooperate to convert the prior art jerry can into a safety can.

Further objects and advantages of the invention will become apparent from the following description taken in conjunction with the accompanying drawings.

BRIEF DESCRIPTION OF THE DRAWINGS

FIG. 9 is a top plan view of the converted jerry can and adapter unit of FIG. 8;

FIG. 10 is a side elevational view of the operating handle of FIGS. 8 and 9 in its "down" position in which the cover of the converted Jerry can is closed;

FIG. 11 is a side elevational view of the operating handle of FIG. 10 at its initial position for opening the cover, but in which the safety cap or cover is still closed;

FIG. 12 is a side elevational view of the operating handle in standard pouring position with the handle engaging the stop point; and FIG. 13 is a side elevational view of the operating handle pulled beyond the normal stop point for replacement of the filter screen (flame arrestor) or for filling the container.

DETAILED DESCRIPTION OF THE DRAWINGS

Figure 1:
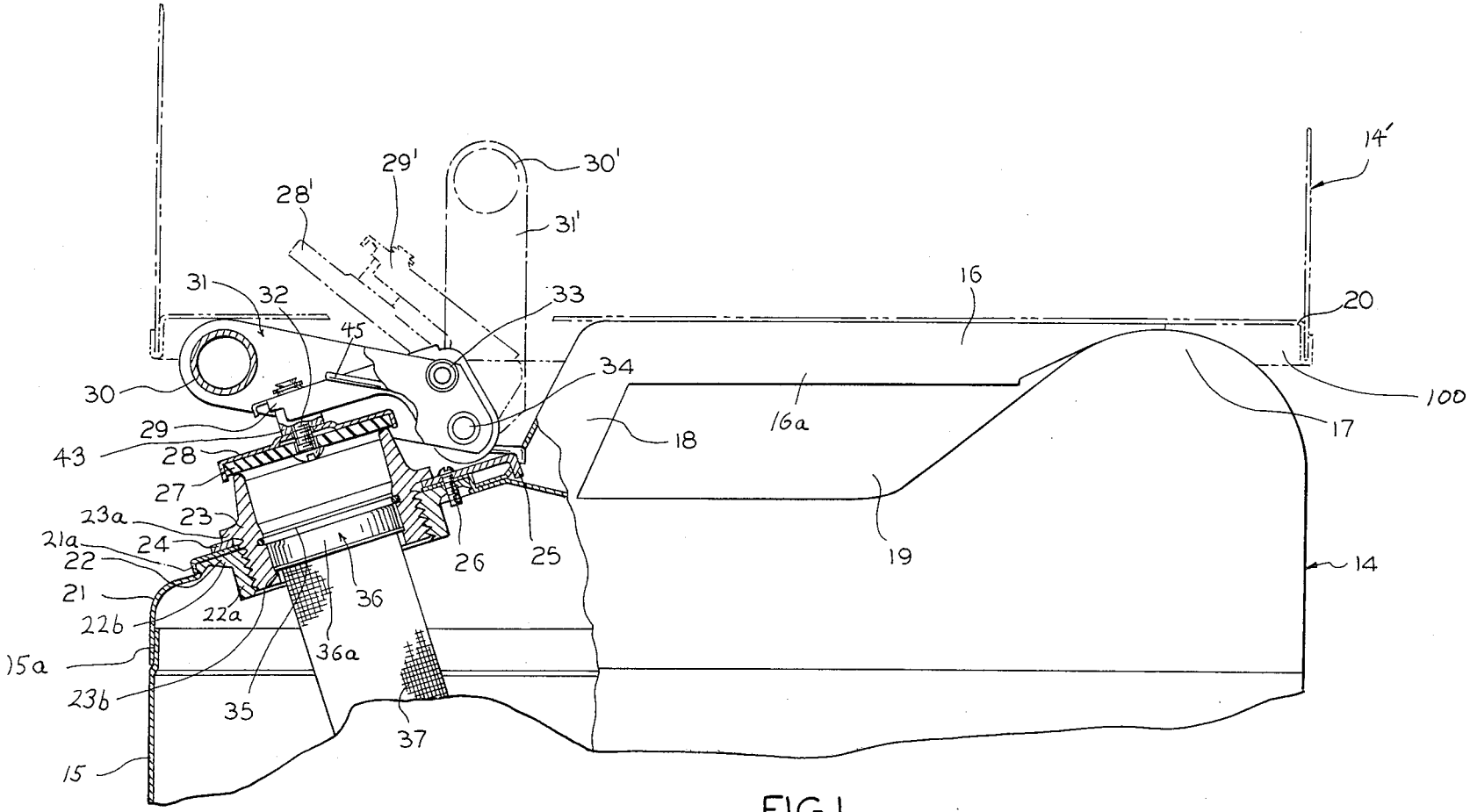
FIG. 1 is a side elevational view showing a standard Jerry can converted to a safety container using the adapter arrangement of the invention.

Referring now to FIGS. 1 through 7, inclusive of the drawings, and more particularly to FIG. 1, there is shown a receptacle or container generally indicated at 14 for inflammable fluids, such as gasoline or the like, which may be generally similar in shape to the jerry can shown in the aforementioned Flider '200 patent. Container 14 includes a lower body portion such as lower body portion 15 and an upper body portion 21 which is connected to lower body portion 15 by a lap joint 15A. The jerry cans of both embodiments of the invention shown and described in the present application may be made of a metal, such as steel, may be made of blow-molded plastic as in the case of the jerry can of the aforementioned Flider '200 patent, or may be made of injection-molded plastic as in the case of the aforementioned Schiemann '002 patent. The principles of the present invention are applicable regardless of the material of which the container is made.

Figure 3:
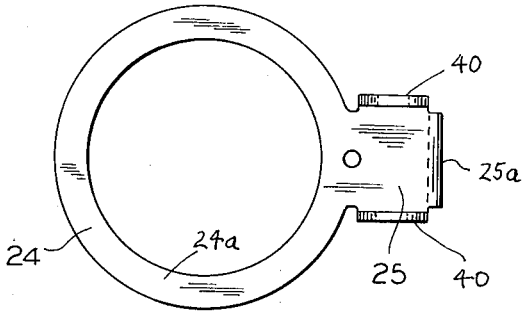
FIG. 3 is a top plan view of the pour spout flange of the adapter unit of FIG. 1.
Figure 4:
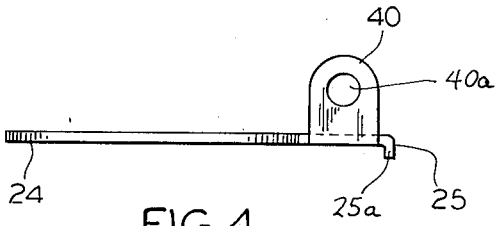
FIG. 4 is a side elevational view of the pour spout flange of FIG. 3.
Figure 5:
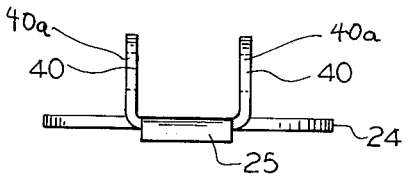
FIG. 5 is an end view of the pour spout flange looking in from the right-hand end of FIG. 4.

The left-hand portion of upper body portion 21 of the container as seen in FIG. 1 is tapered, and the material of upper body portion 21 in the tapered region is formed to define a radially inwardly turned external flange 21A which bounds an opening through which pour spout 23 extends. External flange 21A overlies and is reinforced by a neck member 22 having a cylindrical body portion 22A and a radially outwardly extending flange portion 22B. Neck member 22 is formed of material having a substantially greater thickness than the material of which the body of container 14 is made. Neck member 22 is a permanent part of the container. The right-hand portion of the upper end of container 14 as viewed in FIG. 1 is contoured to define a hump 17. Carrying handle 16 is provided in the same general manner as shown in the aforementioned Flider '200 and Schiemann '002 patents. The upper surface of handle 16 lies in a common normally horizontal plane. Handle 16 includes a normally horizontal portion 16A which is connected at its right-hand end relative to the view of FIG. 1 to hump 17 of the container. Handle 16 also includes at its left-hand end, as viewed in FIG. 1, a downwardly inclined portion 18 which is suitably connected to an intermediate portion of the top surface of upper body portion 21 of the container. An open space 19 is defined between the upper surface of upper body portion 21 and the under surface of horizontal portion 16A of the handle. The user of the container may insert his fingers through space 19 when handle 16 is being grasped. A pour spout flange 24, the details of which are best shown in FIGS. 3, 4 and 5, and which will be described in more detail hereinafter, is positioned in overlying relation to the radially outer surface of external flange 21A on upper body portion 21 and in circumscribing relation to the opening defined by external flange 21A and neck 22. Pour spout flange 24 is secured in position by a self-tapping screw 26 which passes through pour spout flange 24, through external flange 21A of upper body portion 21, and through the hole in flange portion 22B of neck member 22 to which the container vent tube had previously been connected, as shown for example, in the aforementioned Flider '200 patent.

A hollow pour spout generally indicated at 23 is provided which includes a lower externally screw-threaded portion which engages with the internal threads on neck 22. Pour spout 23 is provided intermediate its height with a radially outwardly extending integral external flange 23A which seats on the outer surface of pour spout flange 24 when pour spout 23 is in complete screw-threaded engagement with neck member 22.

In order to prevent fluid leakage at the interface between the threads of neck 22 on upper body portion 21 and the inner threaded end of pour spout 23, the mating surfaces of neck 22 and of pour spout 23 may be coated with a suitable epoxy resin which forms a fluid-tight seal between these members.

A flame arrestor sub-assembly generally indicated at 36 is suspended from the interior of pour spout 23 and projects into the interior of the upper end of container 14. Flame arrestor sub-assembly 36 includes a gathering ring 36A from which is suspended a filter screen 37 which strains the fluid entering and leaving the converted container and also serves as a fire barrier. Gathering ring 36A of the flame arrestor sub-assembly seats on a shoulder 23B formed on the inner periphery of the lower end of pour spout 23. A retaining ring 35 is received in a peripheral groove on the inner periphery of pour spout 23 and serves to prevent unintended outward movement of flame arrestor sub-assembly 36-37.

As best seen in FIGS. 3, 4 and 5, pour spout flange 24 includes an annular-shaped portion 24A adapted to circumscribe the outer periphery of pour spout 23. Pour spout flange 24 also includes a radially outwardly projecting tongue portion 25 which extends beyond the outer circumference of annular portion 24A and includes a downwardly bent portion 25A. A pair of leg members indicated at 40 extend perpendicularly to the plane of tongue portion 25 of pour spout flange 24.

Each of the upstanding leg members 40 includes a centrally located aperture or passage 40A therethrough. The upwardly extending legs 40 and the apertures 40A therein serve as a pivotal mounting means for operating handle 31 which will now be described.

Figure 6:
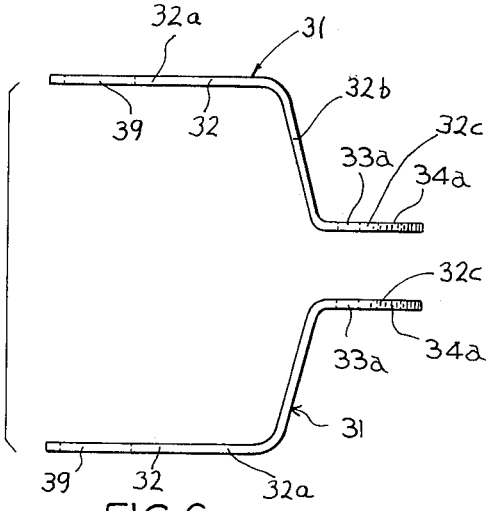
FIG. 6 is a top plan view of the two handle straps of the adapter device of FIG. 1.
Figure 7:
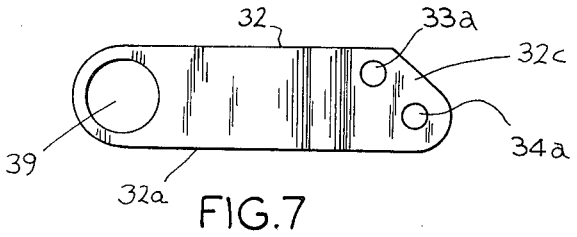
FIG. 7 is a side elevational view of one of the handle straps of FIG. 6.

As best seen in FIGS. 6 and 7, a pivotally mounted operating or control handle generally indicated at 31 is provided to control the opening of the safety cap to be hereinafter described. Handle 31 includes a pair of handle straps, indicated at 32. Handle straps 32 include a laterally outer straight portion 32A, a lateral inwardly extending tapered strap portion 32B, and laterally inner straight strap portion 32C which extend rearward from the inner end of the corresponding tapered strap portion 32B. The straight portions 32A of the two handle straps 32 are provided with aligned apertures, indicated at 39, which are adapted to receive the opposite ends of the crossbar portion 30 of handle member 31.

Also, straight portions 32C of the respective handle straps 32 are provided with a forward aperture 33A and a rearward aperture 34A as best seen in FIGS. 6 and 7. Handle 31 is pivotally mounted to leg members 40 of pour spout flange 24 by means of a pivot pin 34 in FIG. 1, which extends through the aligned apertures 34A of the handle straps and through the apertures 40A of leg members 40 of pour spout flange 24. Pivot pin 34 may be a rivet.

The safety cap 28 which normally seats on the outer end of pour spout 23 includes a gasket 27 which seals against the upper or outer end of pour spout 23 when cap 28 is in the closed position shown in FIG. 1.

The movement of cap 28 to an open position is controlled by control handle 31 and a linkage or cover bracket 29 which will now be described.

Screw 32 secures a pin bracket 43 to the upper end of safety cap 28, and an L-shaped cover bracket 29 is loosely connected to pin bracket 43 and thus to safety cap 28. The L-shaped cover bracket 29 is also pivotally connected about the axis of pin 34 to leg members 40 of pour spout flange 24 whereby cover bracket 29 moves pivotally about pivot pin 34 along with handle 31. Thus, handle 31 and cover bracket 29 are both mounted for pivotal movement about the axis of pin 34. Handle 31 is connected to cover bracket 29 by means of pin 33 which passes through apertures 33A of handle strap portions 32C, with pin 33 also passing through a corresponding passage or aperture in cover bracket 29. A spring 45 bears against the upper surface of cover bracket 29, as best seen in FIG. 1, with the end of spring 45 bearing against the downwardly turned lip portion 25A of pour spout flange 24. Spring 45 constantly exerts a force against cover bracket 29 which urges cap 28 into a closed position. Spring 45 of FIG. 1 may be similar to spring 71 shown in FIG. 9.

In using the converted container 14 of FIGS. 1 through 7, when it is desired to pour the inflammable fluid, such as gasoline and the like, handle assembly 31 is swung in a clockwise direction relative to FIG. 1 about the axis of pin 34 to approach the phantom line position of FIG. 1. Due to the interconnection provided between handle assembly 31 and cover bracket 29 by pin 33, movement in a clockwise direction of handle assembly 31 causes clockwise movement of cover bracket 29 about the pivotal axis 34, without any lost motion, to cause cover bracket 29 and cap member 28 to move toward the dotted line phantom positions indicated at 28'–29', the movement of cover bracket 29 being against the biasing force of spring 45. When handle 31 is released with safety cap 28 in an open position, spring 45 forces cap 28 back to a closed position and also moves handle assembly 31 back to the closed position. If an excessive pressure occurs within container 14, cap 28 opens against the force of spring 45 to vent container 14. Cap 28 is reclosed by the force of spring 45 when the pressure inside container 14 lowers to a predetermined acceptable value.

It should be noted that the sub-assembly which is used to modify the prior art Jerry can to convert it into a safety can may be permanently affixed or removed and transferred to a different container if the original container becomes unusable. Thus, with respect to the embodiment shown in FIGS. 1 through 7 inclusive, the sub-assembly comprising pour spout 23 and attached flame arrester sub-assembly 36, pour spout flange 24, safety cap 28 and attached pin bracket 43, cover bracket 29, operating handle 31, and spring 45 may all be removed by unscrewing screw 26 from engagement with neck member 22 and with flange 21A of upper body portion 21 of container 14. Pour spout 23 may then be unscrewed from neck 22 at the upper end of container 14 to permit removal of the entire adapter sub-assembly from container 14. Neck 22 remains as a permanent part of container 14.

Figure 2:
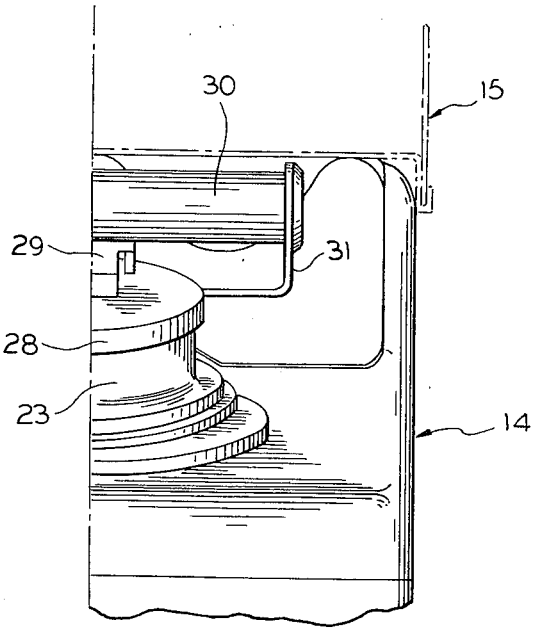
FIG. 2 is an end view of the converted container looking in from the left-hand end of FIG. 1.
Figure 8:
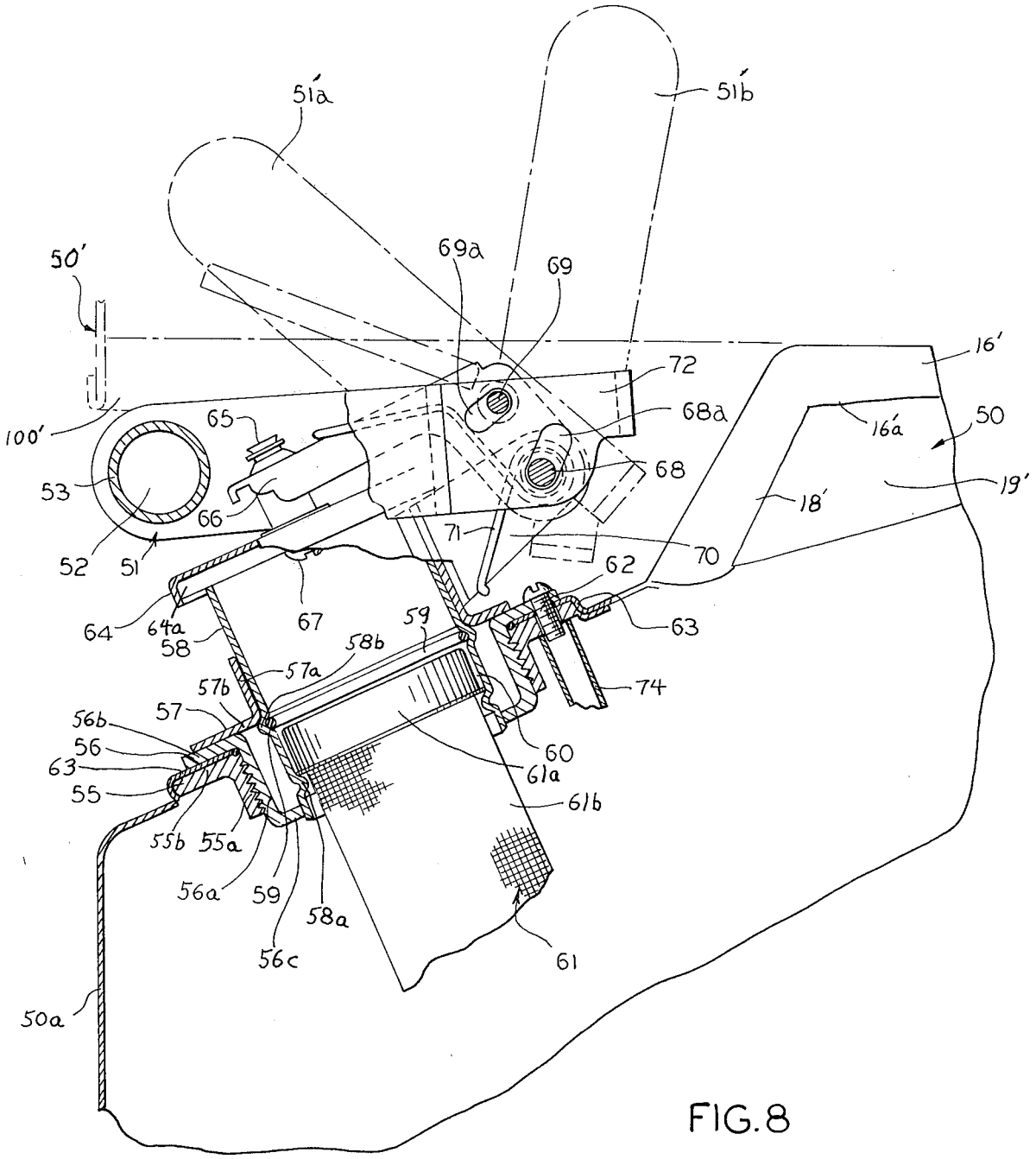
FIG. 8 is a sectional view of a modified adapter arrangement for converting a conventional jerry can into a safety container.

Referring now to FIGS. 8 through 13 inclusive, there is shown a fragmentary view of a Jerry can generally indicated at 50, which may be similar to the Jerry can shown in the aforementioned Flider '200 patent and similar to container 14 shown in FIGS. 1 and 2 of the present application. The Jerry can 50 of the embodiment of FIG. 8 includes a body 50A and a carrying handle as shown in the aforementioned Flider '200 patent, although only a fragmentary portion of this handle indicated at 16' is shown in FIG. 8. Handle 16' of FIG. 8 includes a horizontal portion 16A' and an inclined portion 18' which are respectively similar to the handle portions 16A' and 18 of the embodiment of FIG. 1.

At the left-hand side of the upper end of Jerry can 50 as viewed in FIG. 8, the material of the Jerry can is formed to define a radially inwardly turned external flange 63. External flange 63 overlies an internal neck member 55 formed of material having a greater thickness than that of Jerry can body 50A. Neck member 55 includes a hollow cylindrical body portion 55A and a flange portion 55B. Body portion 55A is internally threaded. A collar member generally indicated at 56 is provided and includes a generally cylindrical-shaped body portion 56A, a radially outwardly extending flange 56B at the upper end of collar member 56, and a radially inwardly extending flange 56C at the lower end of collar member 56. Collar 56 is adapted to threadedly engage neck member 55 by means of external screw threads on body portion 56A which threadedly engage internal threads on body portion 55A. The mating threaded surfaces of neck member 55 and collar 56 are coated with a suitable epoxy resin to provide a fluid-tight seal between neck member 55 and collar 56.

Collar member 56 is secured in position and against any rotation relative to Jerry can body 50A by means of a screw member 62 which extends through a passage in flange 56B of collar member 56, through flange 63 of Jerry can body 50A, and through flange portion 55B of neck member 55. It will be noted that the screw 62 extends into the upper end of the internal vent tube 74 which is part of the structure of the Jerry can 50 which is being converted, the vent tube 74 serving no function in this embodiment and being plugged permanently.

A sleeve member generally indicated at 57 is provided and includes a cylindrical sleeve portion 57A and a radially outwardly extending flange portion 57B. Flange portion 57B rests on and, in the final assembly, is secured by means of spot welds to the upper surface of flange portion 56B of collar 56.

Sleeve portion 57A of sleeve member 57 and the radially inwardly extending flange portion 56C of collar 56 cooperate to secure in position, a pour spout generally indicated at 58. Pour spout 58 is a generally hollow cylindrical member open at both of its axially opposite ends and secured by spot welds to the inner periphery of sleeve portion 57A. The upper or axially outer end of pour spout 58 is open and serves as a seat for the safety cap member generally indicated at 64, the gasket 64A sits on the upper edge of pour spout 58.

The lower or axially inner end of pour spout 58 is engaged and stabilized by the radially inner edge of flange 56C, with flange 56C being soldered to the outer periphery of the axially inner end of pour spout 58.

The axially inner portion of pour spout 58 also cooperates to support and retain a flame arrester sub-assembly generally indicated at 61, which is similar to flame arrester sub-assembly 36 shown in the embodiment of FIGS. 1 through 7 and includes a gathering ring 61A from which is suspended filter screen 61B which strains the fluid entering and leaving the converted Jerry can 50. Gathering ring 61A of the flame arrester sub-assembly seats on a shoulder defined by a radially inwardly turned bead 58A on the axially inner portion of pour spout 58. A second bead 58B is provided in pour spout 58 at a level above gathering ring 61A of flame arrester sub-assembly 61, bead 58B opening inwardly and defining a groove which receives a lock ring 59 which serves as an abuttment to limit axially outer movement of flame arrester sub-assembly 61.

A handle assembly generally indicated at 51 is provided and includes a pair of handle straps, each indicated at 51A, which are pivotally mounted on a pair of spaced bracket arms 70 which are rigidly secured to the outer surface of pour spout 58. The two handle straps 51A are connected to each other by crossbar 53.

Each of the opposite handle straps 51A is provided at the lower portion thereof with an elongated slot or opening 68A which receives a pivot pin 68 passing through the laterally spaced stationary bracket arms 70. Pin 68 serves as a pivotal support for handle assembly 51 An L-shaped cover bracket 66 is loosely connected to a pin bracket 65 which in turn is secured to safety cap 64 by means of screw 67. Cover bracket 66 is pivotally mounted about the axis of pin 68 for pivotal movement with respect to mounting brackets 70. Thus, handle assembly 51 and cover bracket 66 are both mounted for pivotal movement about a common axis, namely, the axis of pin 68.

Safety cover 64 is constantly biased toward closing position by a coil spring generally indicated at 71. Coil spring 71 includes two coil sections 71A and 71B, respectively, which are wound around pivot pin 68 about which handle 51 and also cover bracket 66 are pivotally mounted. The left-hand end of coil 71 (as viewed from the left end of FIG. 9 and indicated at 71C) is anchored beneath the left-hand stationary bracket arm 70, as viewed from the left-hand end of FIG. 9. Similarly, the right-hand end of coil spring 71 as viewed from the left-hand end of FIG. 9, and indicated at 71D, is anchored beneath the right-hand stationary bracket arm 70 as viewed from the left-hand end of FIG. 9. One end of spring coil section 71A, indicated at 72E, is brought out and connected to one end of coil spring section 71B, as indicated at 71F, with the ends of the two coil springs 71A and 71B being connected by the portion 71G. The connected spring portions 71E, 71F and 71G together define a U-shaped spring member which forms part of the spring sections 71A and 71B and which bears against the outer surface of L-shaped cover bracket member 66 to constantly urge safety cap 64 toward a closed position.

A pin member 69 extends through the trailing or right-hand end portions 66A and 66B of L-shaped cover bracket 66 as shown in FIG. 9, the opposite ends of pin 69 being received in oppositely disposed elongated slots 69A of the oppositely disposed handle straps 51A. Pin 69 is a lift pin is which operatively connected cover bracket 66 to operating handle 51 to effectuate opening movement of L-shaped cover bracket 66 and the attached safety cover or cap 64 when operating handle 51 is moved to an open position as will be described.

When operating handle 51 is in its downward position and safety cap 64 is closed, as seen in full line in FIG. 8, cover bracket lift pin 69 is in the upper end of slot 69A and pivot pin 68, about which handle 51 and L-shaped cover bracket 66 aree both pivotally movable, is in the lower end of its corresponding slot 68A. See also in FIG. 10.

When it is desired to open safety cap or cover 64, handle 51 is swung in a clockwise direction as viewed in FIGS. 8 and 9, causing slot 68A in handle 51 to move in a clockwise direction from the position of FIG. 10 to the position of FIG. 11, whereby to cause pivot pin 68 to lie in the right-hand end of slot 68A as viewed in FIG. 11 and whereby to cause cover bracket lift pin 69 to lie at the left-hand end of slot 69A as viewed in FIG. 11. In the view of FIG. 11, safety cap 64 is still closed, but the various cooperating members, including handle 51 and cover lift bracket 66 are just as the starting point to begin opening cap 64.

The view of FIG. 12 shows the position of handle 51 when it has been swung clockwise from the FIG. 11 position to the standard pouring position (shown in phantom line at 51B in FIG. 8), in which the right-hand end of handle 51 strikes up against the underneath edge of laterally spaced stationary brackets 70 which define a stop point for opening movement of handle 51 corresponding to the pouring position of safety cover 64 with respect to pour spout 58. During the movement of handle 51 from the FIG. 11 position to the FIG. 12 position in which safety cap 64 is open for pouring, the movement of handle 51 is transmitted to cover bracket 66 and thus to safety cap 64 by the engagement of cover bracket lift pin 69 with the bounding edge of slot 69A of handle 51.

FIG. 13 represents the position of operating handle 51 and the cooperating pins 68, 69 and slots 68A and 69A when handle 51 has been pulled beyond the normal stop oint as might be required, for example, for replacement of filter screen 61 or for filling the container if necessary. When handle 51 is pulled beyond the stop point as shown in FIG. 13, dog 51B on the outer end of each handle strap 51A slides along the edge of the corresponding bracket arm 70 to cause handle strap 51A and slot 68A thereof to shift relative to pivot pin 68 as will be seen by comparing FIG. 13 with FIG. 12. Pivot pin 68 remains in the same position relative to its mounting on stationary bracket 70, but moves relatively upwardly in the slot 68A in which pin 68 is received, as will be seen by a comparison of FIGS. 12 and 13, although lift point 69 remains at the same relative position in slot 69A in both FIGS. 12 and 13. The movement of slot 68A relative to pivot pin 68, by which pin 68 moves upwardly in slot 68A as seen in FIG. 13 upon movement of handle 51 beyond the stop point avoids any additional stress or strain on the operating mechanism.

As can best be seen in FIG. 1, the prior art Jerry can having attached thereto the cooperating safety cap and handle mechanism in accordance with the present invention, and which converts the prior art Jerry can into a safety can, can be stacked in the same manner as is possible with prior art Jerry cans which do not have mounted thereon the adapter device of the invention. Thus, as seen in FIG. 1, when handle assembly 31, cover bracket 29, and safety cap 28 are in the closed position shown in full line in FIG. 1, another converted container 14', which is similar in all respects to the converted container 14 hereinbefore described and shown in the drawings, can be stacked on top of the lower container 14. Thus, the container 14' as shown in phantom in FIG. 1, like all of the converted containers of the invention, has a bottom wall indicated at 100 which is recessed inwardly from the bottom thereof and which is adapted to rest in a nested relation on the normally horizontal flat upper surface of carrying handle or handles 16 of lower container 14.

Handle assembly 31, including crossbar 30, is so dimensioned as to length and width and also with respect to the angle of the handle assembly relative to the horizontal that the folded handle assembly remains within the confines of the perimeter of container 14 (FIGS. 1 through 7, inclusive) or 50 (FIGS. 8 through 13, inclusive), thereby facilitating the stacking of the containers.

It should also be noted that when handle 51 (FIG. 8) is in its closed position, there is a clearance between the upper end of the handle and the under surface of container 50' stacked above it to permit opening of the safety cap 28 (FIG. 1) for venting of the interior of container 50 without movement of handle 51 in the event of excessive pressure within the container, due to the lost motion assembly associated therewith.

As previously mentioned, container 14 (FIG. 1), or 50 (FIG. 8), may have a shape generally similar to that of the Jerry can shown in the aforementioned Flider '200 patent and includes front and back walls, with each of said walls having a major surface area thereof extending in parallel relation to a major surface area of the other said walls. The container body also includes laterally opposite end walls, each of which has a major surface area thereof extending parallel to a major surface area of the other end wall. The major surface areas of the end walls extend substantially perpendicular to the major surface areas of the front and back walls to define a container body having a substantially rectangular perimeter, although the corners thereof may be rounded as shown in the aforementioned Flider '200 patent. The construction of the converted container 14 (FIG. 1) and 50 (FIG. 8) as just described, plus the arrangement of the handle assembly on the upper end of each container as previously described, permits a plurality of converted containers to be placed side by side, front to back, and top to bottom for efficient space utilization for storage and/or transportion.

As previously described in connection with the container adapter sub-assembly of the embodiment of FIGS. 1 through 7 inclusive, and the container adapter sub-assembly of the embodiment of FIGS. 8 through 13, inclusive, may also be detached from container 50 and transferred to a different container if the original container 50 becomes unusable for some reason or may be permanently affixed FIGS. 8 through 13 inclusive, the sub-assembly comprising pour spout 58, sleeve member 57 which is attached to pour spout 58 and collar 56, collar 56 which is in screw-threaded engagement with neck 55, flame arrester sub-assembly 61, safety cap 64, pin bracket 65 attached to safety cap 64, cover bracket 66, handle 51, and spring 71, may all be removed together from the upper end of container 50. The adapter sub-assembly just described may be removed from container 50 by removing screw 62 from its engagement with neck 55 and with flange 63 of container 50A, and by then unscrewing collar 56 from its screw-threaded engagement with neck member 55 on container 50A. Neck member 55 remains as a permanent part of container 50A.

From the foregoing detailed description of the invention, it has been shown how the objects of the present invention have been obtained in a preferred manner. However, modifications and equivalents of the disclosed concepts such as readily occur to those skilled in the art are intended to be included within the scope of the invention.

What is claimed is:

1. An improved safety dispensing container including a container body having a hollow interior for receiving fluid contents, the upper surface of said container body being provided with an opening through which said fluid contents may be poured, said opening being located proximate to one edge of said upper surface of said container body, said container further including means defining a flat normally horizontal region from a point substantially proximate to said opening in said container and extending substantially to that end of said container body located opposite to said opening, said flat normally horizontal region being elevated above said opening whereby an open region is defined between that portion of said body immediately proximate to said opening, the rising portion of said elevated flat normally horizontal region, and a line extending from said horizontal region across said opening, said elevated flat horizontal region being adapted to serve as a seat for the recessed bottom portion of another similar container positioned in stacked relation above said safety dispensing container, said recessed bottom portion of said safety dispensing container being cooperatively adapted to seat on said elevated flat normally horizontal region of still another similar container positioned in stacked relation beneath said safety dispensing container, said improved safety dispensing container further including safety closure means, said safety closure means comprising:

pour spout means, said pour spout means secured in said opening;

safety cap means, said safety cap means adapted to seat on the outer end of said pour spout means in closing relation to said pour spout means whereby a substantially fluid-and-vapor-tight seal results when said safety cap means is in a closed position;

operating handle means;

pivot support means, said pivot support means secured to the upper end of said container body proximate to said opening;

said pivot support means supporting siad operating handle means for pivotal movement thereof;

link means, said link means connecting said safety cap means to said operating handle means whereby pivotal movement of said operating handle means is effective to selectively move said safety cap means from a closed position to an open position relative to said pour spout mens;

said operating handle means being pivotally connected on one side and extending over and across said spout's outer end opening, whereby said operating handle makes supporting and stabilizing contact with a bottom of a stacked Jerry can when said safety cap is in its closed position;

spring means, said spring means cooperating with said link means to bias said link means to a default position wherein said safety cap means is securely seated on said pour spout means in said closed position;

said safety closure means being designed to fit completely within said open region when in said closed position, whereby said handle means, said link means, said pour spout means, and said safety cap means will not interfere with said recessed bottom portion of another similar container positioned in said stacked relation above said given safety dispensing container.

2. An improved safety dispensing container as defined in claim 1 wherein said flat normally horizontal region comprises a carrying handle on the upper surface of said container body, said carrying handle being shaped to include a flat normally horizontal handle portion which extends for a substantial portion of the length of said container.

3. An improved safety dispensing container as defined in claim 1 including a neck member bounding said opening and forming part of said container body, said pour spout means being detachably secured in said neck member.

4. An improved safety dispensing container as defined in claim 3 which said neck member and said pour spout means are provided with cooperating threaded surfaces whereby said pour spout means is detachably threadedly engaged with said neck member.

5. An improved dispensing container as defined in claim 1 in which said link means is supported for pivotal movement by said pivot support means and is pivotally movable about the same pivotal axis as said operating handle means.

6. An improved safety dispensing container as defined in claim 1 further comprising a flame arrester means suspended from the interior of said spout means and extending into the upper end of said container body.

7. An improved safety dispensing container as defined in claim 1 further comprising a pour spout flange seated on the upper end of said container body, said pour spout flange including an annular portion surrounding said pour spout means, and means carried by said pour spout flange and defining said pivot support means.

8. A safety dispensing container as defined in claim 1 in which said container body includes a first pair of spaced walls defining the front and back walls of said container body, each wall of said first pair respectively having a major surface area thereof extending in spaced and substantially parallel relation to a corresponding major surface area of the other wall of said first pair, said container body including a second pair of spaced walls defining the laterally opposite end walls of said container, each wall of said second pair respectively having a major surface area thereof extending in spaced and substantially parallel relation to a corresponding major surface area of the other wall of said second pair, said major surface areas of said end walls extending substantially at right angles to said major surface areas of said front and back walls to define a container body having a substantially rectangular perimeter, whereby a plurality of said containers may be placed side by side, front to back, and top to bottom, for efficient space utilization during storage and/or transportation.

9. An improved safety dispensing container as defined in claim 1 including a lost motion connection between said operating handle means and said link means whereby said operating handle means has a predetermined movement before actuating said link means to open said safety cap.

10. An improved safety dispensing container as defined in claim 1 in which said container body is made of blow-molded plastic.

11. An improved safety dispensing container as defined in claim 1 in which said safety closure means is designed to permit said safety cap means to open sufficiently with respect to said pour spout means to allow vapors to controllably escape when the pressure inside said container relative to the ambient atmospheric pressure exceeds a predetermined maximum corresponding to the biasing force of said spring means, whereby said excess pressure may be safely vented.

12. An improved safety closure adapter arrangement for mounting on a storage container such as the type known as a Jerry can, said container including a hollow interior for receiving fluid contents, the upper surface of said container being provided with an opening though which said fluid content may be poured, said improved safety closure adapter arrangement comprising:

pour spout means;

means for securing said pour spout means in said opening;

safety cap means, said safety cap means adapted to seat on the outer surface of said pour spout means in closing relation to said pour spout means whereby a substantially fluid-and-vapor-tight seal results when said safety cap means is in a closed position;

operating handle means;

pivot support means, said pivot support means designed to be secured to the upper end of said container proximate to said opening;

said pivot support means supporting said operating handle means for pivotal movement thereof;

link means, said link means connecting said safety cap means to said operating handle means whereby pivotal movement of said operating handle means is effective to selectively move said safety cap means from a closed position to an open positon relative to said pour spout means;

said operating handle means being pivotally connected on one side and extending over and across said spout's outer end opening, whereby said operating handle makes supporting and stabilizing contact with the bottom of a stacked Jerry can when said safety cap means is in its closed position;

spring means, said spring means cooperating with said link means to bias said link menas to a default position wherein said safety cap means is securely seated on said pour spout means in said closed position;

said improved safety closure adapter arrangement being designed to fit completely within the open region of the Jerry can proximate to said opening when in said closed position, whereby said handle means, said link means, said pour spout means, and said safety cap means do not extend beyond the sides of said container or above a line extending from the elevated horizontal handle of said Jerry can.

13. An improved safety closure adapter arrangement as defined in claim 12 in which said storage container includes a neck member bounding said opening and forming part of said container body, said pour spout means being detachably secured in said neck member.

14. An improved safety closure adpater arrangement as defined in claim 13 in which said neck member and said pour spout means are provided with cooperating threaded surfaces whereby said pour spout means is detachably threadedly engaged with said neck member.

15. An improved safety closure adapter arrangement as defined in claim 12 in which said link means is supported for pivotal movement by said pivot support means and is pivotally movable about the same pivotal axis as said operating handle means.

16. An improved safety closure adapter arrangement as defined in claim 12 further comprising a flame arrester means suspended from the interior of said pour spout means and adapted to extend into the upper end of said container body.

17. An improved safety closure adapter arrangement as defined in claim 12 further comprising a pour spout flange adapted to seat on the upper end of said container body, said pour spout flange including an annular portion surrounding said pour spout means, and means carried by said pour spout flange and defining said pivot support means.

18. An improved safety closure arrangement as defined in claim 17 comprising means detachably securing said pour spout flange to the upper end of said container body.

19. An improved safety closure arrangement as defined in claim 12 including a lost motion connection between said operating handle means and said link means whereby said operating handle means has a predetermined movement before actuating said link means to open said safety cap means.

20. An improved safety closure adapter arrangement as defined in claim 12 in which said safety cap means may open sufficiently with respect to said pour spout means to permit the controlled escape of vapors when the pressure inside said container relative to the ambient atmospheric pressure exceeds a predetermined maximum corresponding to the biasing force of said spring means, whereby said safety closure adapter means may safely vent said excess pressure from said container.

* * * * *

UNITED STATES PATENT AND TRADEMARK OFFICE

CERTIFICATE OF CORRECTION

PATENT NO. : 4,394,937

DATED : July 26, 1983

INVENTOR(S) : FRANK S. FLIDER

It is certified that error appears in the above-identified patent and that said Letters Patent are hereby corrected as shown below:

Col. 2, line 3: "safty" should be --safety--;

Col. 5, line 22: "mounted" should be --connected--;

Col. 8, line 1: "72E" should be --71E--;

Col. 8, line 16: "is which" should be --which is--;

Col. 8, line 25: "aree" should be --are--;

Col. 8, line 58: "oint" should be --point--;

Col. 9, line 64: "transportion" should be --transportation--;

Col. 10, line 67: "siad" should be --said--;

Col. 11, line 6: "mens" should be --means--;

Col. 11, line 50: Add --pour-- before "spout means";

UNITED STATES PATENT AND TRADEMARK OFFICE

CERTIFICATE OF CORRECTION

PATENT NO. : 4,394,937

DATED : July 26, 1983

INVENTOR(S) : FRANK S. FLIDER

It is certified that error appears in the above-identified patent and that said Letters Patent are hereby corrected as shown below:

Col. 12, line 34: "though" should be --through--;

Col. 12, line 65: "menas" should be --means--.

Signed and Sealed this

*Twenty-eighth* Day of *February 1984*

[SEAL]

*Attest:*

GERALD J. MOSSINGHOFF

*Attesting Officer*

*Commissioner of Patents and Trademarks*